US008998597B2

(12) United States Patent
Yang

(10) Patent No.: US 8,998,597 B2
(45) **Date of Patent: *Apr. 7, 2015**

(54) COMPRESSOR, ENGINE OR PUMP WITH A PISTON TRANSLATING ALONG A CIRCULAR PATH

(76) Inventor: Yaode Yang, NYC, NY (US)

( * ) Notice: Subject to any disclaimer, the term of this patent is extended or adjusted under 35 U.S.C. 154(b) by 609 days.

This patent is subject to a terminal disclaimer.

(21) Appl. No.: 13/238,107

(22) Filed: Sep. 21, 2011

(65) Prior Publication Data

US 2012/0288390 A1 Nov. 15, 2012

(51) Int. Cl.

| | |
|---|---|
| ***F03C 2/00*** | (2006.01) |
| ***F03C 4/00*** | (2006.01) |
| ***F04C 18/00*** | (2006.01) |
| ***F01C 1/04*** | (2006.01) |
| ***F01C 21/04*** | (2006.01) |
| *F04C 11/00* | (2006.01) |

(52) U.S. Cl.
CPC . *F01C 1/04* (2013.01); *F01C 21/04* (2013.01); *F04C 11/008* (2013.01)

(58) Field of Classification Search
USPC ..... 418/15, 94, 166–168, 171, 183, 418/186–187
See application file for complete search history.

(56) References Cited

U.S. PATENT DOCUMENTS

| | | | | |
|---|---|---|---|---|
| 324,503 A | | 8/1885 | Tilden et al. | |
| 457,294 A | * | 8/1891 | Tilden | 418/166 |
| 2,740,386 A | * | 4/1956 | Crendall | 418/168 |
| 2,956,506 A | * | 10/1960 | Brundage | 418/168 |
| 4,235,217 A | * | 11/1980 | Cox | 123/232 |
| 2013/0071281 A1 | * | 3/2013 | Yang | 418/168 |

FOREIGN PATENT DOCUMENTS

| | | |
|---|---|---|
| CN | 101027487 | 8/2007 |
| CN | 1888435 B | 6/2010 |
| GB | 11485 | 0/1846 |
| JP | 2006002583 A | 1/2006 |
| KR | 20070046935 A | 5/2007 |
| WO | WO2006033500 A1 | 3/2006 |

OTHER PUBLICATIONS

Internet page titled "Rotary Steam Engines: Page 2" retrieved on Sep. 20, 2011 from http://www.douglas-self.com/Museum/Power/rotaryengines/rotaryeng2.htm#elijah46 See pp. 16-18.
PCT Search Report for PCT/CN2012/80277 dated on Nov. 29, 2012.

* cited by examiner

*Primary Examiner* — Theresa Trieu
(74) *Attorney, Agent, or Firm* — IPro, Inc.; Na Xu

(57) ABSTRACT

Described herein is a device comprising: a chamber wall comprising outer and inner surfaces, wherein the inner surface encloses a lobed chamber with a plurality of lobes and the inner surface comprises segments of arcuate surfaces, each of the segments of arcuate surfaces being tangent with its immediate neighboring segments, and wherein the chamber wall further comprises channels connecting the outer surface and the inner surface of the chamber wall and/or channels through an end surface of the chamber wall; a lobed piston configured to translate along a circular path relative to the chamber wall, the outer surface of the piston and the inner surface of the chamber wall engaged during translation and forming a fluid-tight seal between some portions of the outer surface of the piston and the inner surface of the chamber wall such that enclosed spaces are formed between the piston and the chamber wall.

18 Claims, 13 Drawing Sheets

COMPRESSOR, ENGINE OR PUMP WITH A PISTON TRANSLATING ALONG A CIRCULAR PATH

BACKGROUND

Mechanical power can be derived from pressure differential of fluid such as steam. The history of the steam engine stretches back as far as the first century AD. James Watt developed a steam engine that provides a rotary motion suitable for driving factory machinery. This enabled factories to be sited away from rivers, and further accelerated the pace of the Industrial Revolution. Around 1800, Richard Trevithick introduced engines using high-pressure steam. These were much more powerful than previous engines and could be made small enough for transport applications.

A reciprocating compressor or piston compressor is a positive-displacement compressor that uses pistons driven by a crankshaft to deliver gases at high pressure. The intake gas enters the suction manifold, then flows into the compression cylinder where it gets compressed by a piston driven in a reciprocating motion via a crankshaft, and is then discharged. Applications include oil refineries, gas pipelines, chemical plants, natural gas processing plants and refrigeration plants.

SUMMARY

Described herein is a device comprising: a chamber wall comprising an outer surface and an inner surface, wherein the inner surface encloses a lobed chamber with a plurality of lobes and the inner surface comprises segments of arcuate surfaces, each of the segments of arcuate surfaces being tangent with its immediate neighboring segments, and wherein the chamber wall further comprises channels connecting the outer surface and the inner surface of the chamber wall and/or channels through an end surface of the chamber wall; a lobed piston comprising: an outer surface wherein the outer surface encloses a main body of the lobed piston and the outer surface comprises segments of arcuate surfaces, each of the segments of arcuate surfaces being tangent with its immediate neighboring segments, and wherein the main body has a plurality of lobes located in the lobes of the lobed chamber, and wherein the piston is configured to translate along a circular path relative to the chamber wall, the outer surface of the piston and the inner surface of the chamber wall engaged during translation and forming a fluid-tight seal between some portions of the outer surface of the piston and the inner surface of the chamber wall such that enclosed spaces are formed between the lobes of the piston and the lobes of the chamber wall; a seal plate attached to an end of the main body, wherein the seal plate forms a fluid-tight seal with the chamber wall, the seal plate comprises through holes between two opposing surfaces, and the through holes are configured to be fluidly connected to the enclosed spaces. According to an embodiment, a fixed transportation plate with transportation holes contacts the seal plate to control the connection between the enclosed spaces and output space. When the pressure of fluid in the enclosed spaces is increased to certain value, the through holes of seal plate are connected to the transportation holes of transportation plate, then the fluid inside enclosed spaces can be released to the output space.

Also described herein is a method of generating mechanical power using the device summarized above.

Additionally described herein is a method of compressing and/or driving a fluid using the device summarized above.

DETAILED DESCRIPTION

Figure 1:
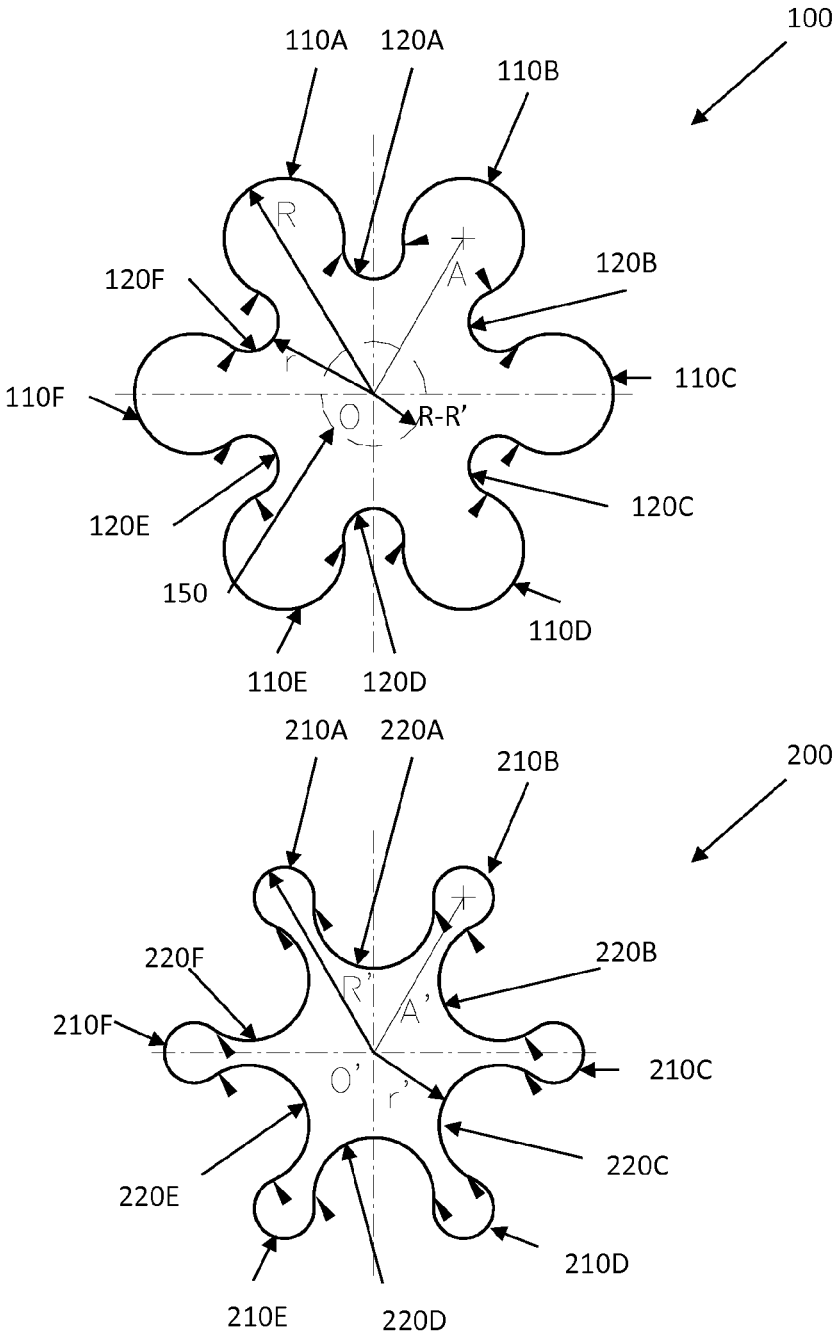
FIG. 1 shows an end view of the inner surface of the chamber wall (left panel) and an end view of the outer surface of the piston (right panel), according to an embodiment.

A device as described herein comprises a chamber wall having an outer surface and an inner surface, the inner surface enclosing a lobed chamber and comprising segments of arcuate surfaces, each of the segments of arcuate surfaces being tangent with its immediate neighboring segments. Two arcuate surfaces "being tangent" as used herein means that the angles between the two arcuate surfaces are zero at an intersecting line between the two arcuate surfaces. The device also comprises a lobed piston located inside the lobed chamber. The piston can have an outer surface comprising segments of arcuate surfaces, each of the segments of arcuate surfaces being tangent with its immediate neighboring segments. The lobes of the piston are located in the lobes of the chamber. The outer surface of the piston encloses a main body of the piston.

The piston is configured to translate along a circular path relative to the chamber wall. Preferably, the piston translates along a circular path concentric with a rotational symmetric center of the chamber wall. Preferably, the piston does not rotate relative to the chamber wall during translation. The outer surface of the piston and the inner surface of the chamber wall are engaged during translation and form a fluid-tight seal between some portions of the outer surface of the piston and the inner surface of the chamber wall, such that enclosed spaces are formed between lobes of the piston and lobes of the chamber wall. As explained in more details below, the enclosed spaces between a lobe of the piston and the lobe of the chamber in which the lobe of the piston is located change volume during translation. The chamber wall has channels connecting the outer surface and the inner surface of the chamber wall. The channels are fluidly connected to the spaces between a lobe of the piston and the lobe of the chamber in which the lobe of the piston is located. As the spaces expand in volume, fluid can be drawn from the channels into the spaces. The chamber wall having channels connecting the outer surface and the inner surface of the chamber wall reduces fluid flow resistance and increases fluid flow rate.

The piston further comprises a seal plate attached to an end of the main body. The seal plate forms a fluid-tight seal with the chamber wall. The seal plate is preferably circular and extends beyond the lobes of the piston. The seal plate has holes between two opposing surfaces and the through holes can be fluidly connected to the enclosed spaces. Preferably, each of the holes is tangent with one segment of arcuate surface of the outer surface of the piston. The holes in the seal plate preferably are through holes and can have any suitable shape such as circular shape.

The device further comprises a transportation plate that is fixed to and forms a fluid-tight seal with the chamber wall. The transportation plate and the chamber wall enclose the piston in the lobed chamber while allowing the piston to translate therein. The transportation plate urges the piston against a bottom of the chamber and restraints the axial position of the piston. The transportation plate has through holes that overlap and fluidly connect to the holes in the seal plate of the piston, when the piston is selected translational positions of the piston relative to the chamber wall.

The holes in the transportation plate can have any suitable shape. The number of the holes in the transportation plate preferably equals the number of the holes in the seal plate. The number of the holes in the transportation plate preferably equals the number of lobes of the lobed chamber. The holes in the transportation plate preferably are located such that portions of the inner surface of the chamber wall overlap each of the holes in the transportation plate.

According to an embodiment, each of the holes of the transportation plate corresponds to each lobe of the lobed chamber. The location of the holes of the transportation plate are configured such that each hole of the transportation plate overlaps with a hole in the seal plate of the piston and fluidly connect to the lobe of the lobed chamber that the hole of the transportation plate corresponds to, only when an enclosed space forms in the lobe between the chamber wall and the piston and fluid in the sealed place is compressed to a predetermined compression ratio. The term "compression ratio" as used herein means the pressure ratio of compressed fluid to uncompressed fluid. The exact location of the holes in the transportation plate can be changed in order to tune the predetermined compression ratio. When a hole in the seal plate of the piston overlaps with a hole in the transportation plate, compressed fluid in the corresponding enclosed space discharges from the enclosed space through the holes. The hole in the transportation plate disconnects from the enclosed space before a volume of the enclosed space reduces to zero. The transportation plate is configured to prevent fluid leakage.

According to an embodiment, the transportation plate may be fixed or rotatable. The transportation plate and the seal plate cooperatively control the connection between the enclosed spaces and output space. The through holes of the transportation plate and the through holes of the seal plate can be arranged such that when the pressure of fluid in the enclosed spaces increases to a certain value, the through holes of the seal plate and the through holes of the transportation plate may overlap so that the fluid inside the enclosed spaces can discharge therefrom.

Compressed fluid discharged from the lobed chamber through the holes of the seal plate can press the seal plate against the chamber wall so as to enhance the fluid-tight seal between the seal plate and the chamber wall, reduce fluid leakage between the seal plate and the chamber wall, reduce fluid leakage between the lobes of the lobed chamber through any gap between the piston and the bottom of the lobed chamber and reduce any friction between the seal plate and the transportation plate.

According to an embodiment, compressed fluid discharged from the lobed chamber can be used to drive lubricant into any drive shaft of the piston, any gap between the piston and the chamber wall, any gap between the seal plate and the transportation plate wherein the lubricant can reduce friction and form fluid-tight seals.

FIG. 1 shows an end view of the inner surface 100 of the chamber wall 1 (left panel) and an end view of the outer surface 200 of the piston 2 (right panel), according to an embodiment. The inner surface 100 consists of twelve segments of arcuate surfaces: 110A, 120A, 1108, 120B, 110C, 120C, 110D, 120D, 110E, 120E, 110F and 120F. The black triangles mark intersecting lines between neighboring segments. Each segment is tangent to its neighboring segments. For example, 110A is tangent to 120A and 120F; 120C is tangent to 110D and 110C. The inner surface 100 has n-fold rotational symmetry with point O as its rotational symmetric center, wherein n can be any integer greater than one, such as six. r denotes the shortest distance between a point on 120A, 120B, 120C, 120D, 120E and 120F and point O. R denotes the longest distance between a point on 110A, 1108, 110C, 110D, 110E and 110F and point O. Distance from each of the centers of 110A, 1108, 110C, 110D, 110E and 110F to point O is A. The outer surface 200 consists of twelve segments of arcuate surfaces: 210A, 220A, 210B, 220B, 210C, 220C, 210D, 220D, 210E, 220E, 210F and 220F. The black triangles mark intersecting lines between neighboring segments. Each segment is tangent to its neighboring segments. For example, 210A is tangent to 220A and 220F; 220C is tangent to 210D and 210C. The inner surface 200 has n'-fold rotational symmetry with point O' as its rotational symmetric center, wherein n' can be any integer greater than one and preferable equals n. r' denotes the shortest distance between a point on 220A, 220B, 220C, 220D, 220E and 220F and point O'. R' denotes the longest distance between a point on 210A, 210B, 210C, 210D, 210E and 210F and point O'. Distance from each of the centers of 10A, 210B, 210C, 210D, 210E and 210F to point O' is A'. A essentially equals A'. (R-R') essentially equals (r-r'). R is greater than R'. r is greater than r'. The piston 2 translates along a circular path 150 of a diameter of (R-R') and concentric with point O.

FIGS. 2A-2F show locations of the piston 2 relative to the inner surface 100 of the chamber wall 1, as the piston 2 translates along the circular path 150, according to an embodiment. Enclosed spaces, such as enclosed spaces 203 and 204, form between lobes of the outer surface 200 of the piston 2 and lobes of the inner surface 100 of the chamber wall 1, when the piston 2 is at certain translational locations.

Figure 2A:
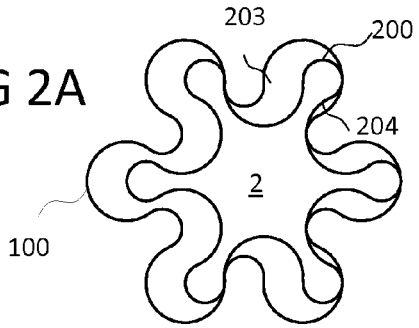
FIG. 2 shows end views of the piston and the inner surface of the chamber wall at six different translation positions.
Figure 2B:
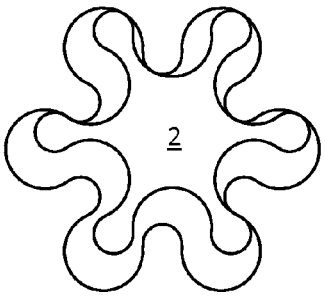
Figure 2C:
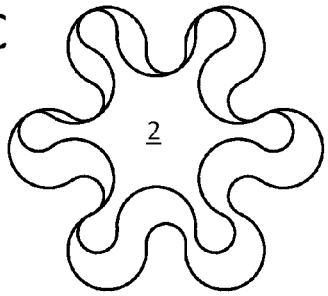
Figure 2D:
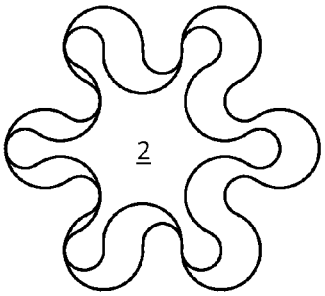
Figure 2E:
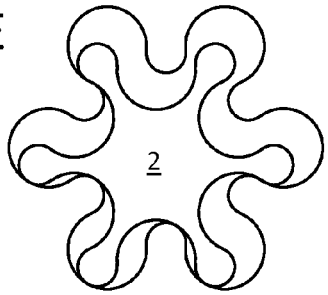
Figure 2F:
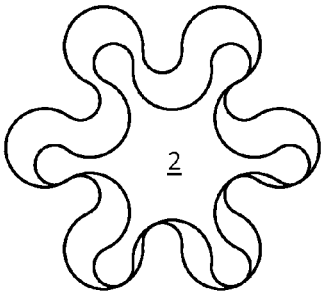

Volume of the enclosed spaces 203 and 204 change as the piston 2 translates along the circular path 150 relative to the chamber wall 1. In this particular example, as the piston 2 translates along the circular path 150 counterclockwise, the enclosed space 203 periodically forms, contracts and disappears (i.e., connected to space between another lobe of the inner surface 100 and the outer surface 200, such as shown in FIGS. 2E and 2F); the enclosed space 204 periodically forms, expands and disappears (i.e., connected to space between another lobe of the inner surface 100 and the outer surface 200, such as shown in FIGS. 2D and 2E). The enclosed space 203 can be used as a compression chamber to compress and/or increase pressure of fluid therein. The enclosed space 204 can be used as an intake chamber to draw fluid to be compressed.

Figure 3A:
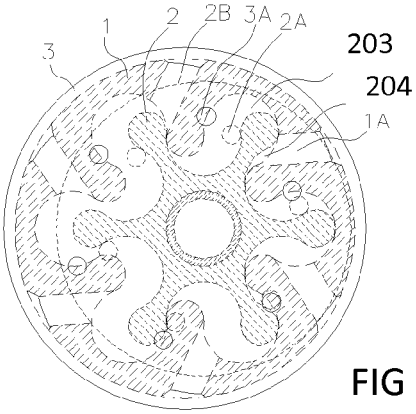
FIG. 3 shows end view of the chamber wall, the piston including the seal plate and holes therein, the transportation plate and holes therein at six different translation positions.
Figure 3B:
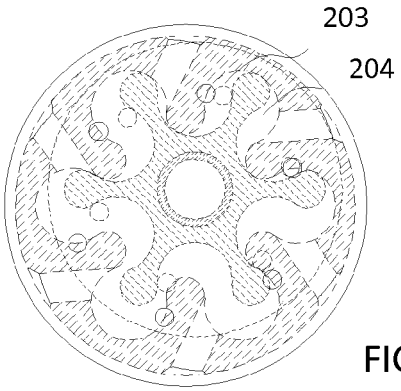
Figure 3C:
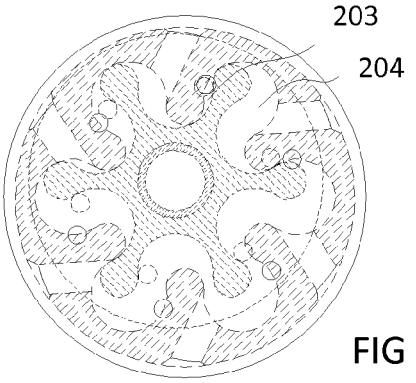
Figure 3D:
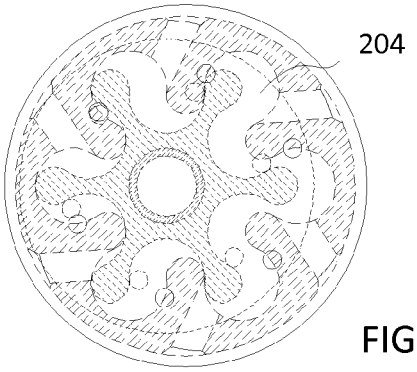
Figure 3E:
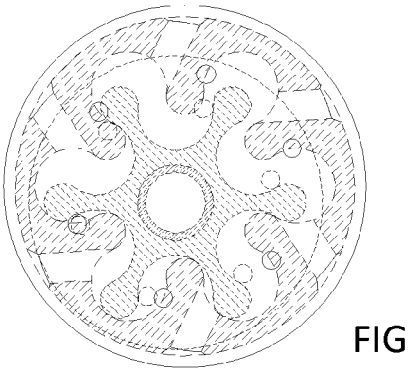
Figure 3F:
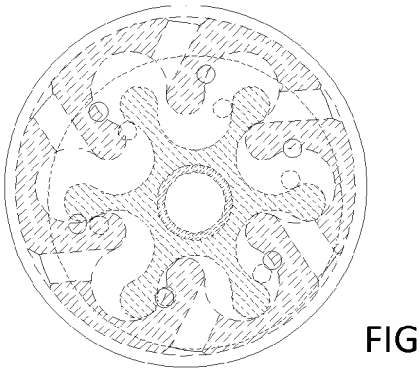

FIGS. 3A-3F correspond to FIGS. 2A-2F, respectively, and additionally show the transportation plate 3 and holes 3A therein, the seal plate 2B of the piston 2 and holes 2A therein. A long dotted line shows the outer surface of the chamber wall 1. A solid line shows the contour of the transportation plate 3. The short dotted line shows the contour of the seal plate 2B. In this particular example, the piston 2 translates along the circular path 150 counterclockwise relative to the chamber wall 1. At the location as shown in FIG. 3A, the hole 2A is not fluidly connected to the hole 3A; the enclosed space 204 is fluidly connected to a channel 1A of the chamber wall 1. At the location as shown in FIG. 3B, the enclosed space 203 has contracted from its state shown in FIG. 3A. Any fluid therein is thus compressed or has elevated pressure. The hole 2A barely fluidly connects to the hole 3A and fluid in the enclosed space 203 begins to be discharged from the enclosed space 203. The enclosed space 204 expands and draws fluid from the channel 1A of the chamber wall 1. At the location shown in FIG. 3C, the hole 2A is fully fluidly connected to the hole 3A and most fluid in the enclosed space 203 has been discharged therefrom. The enclosed space 204 further expands, draws more fluid from the channel 1A, and reaches its maximal volume. At location shown in FIG. 3D, the enclosed space 203 contracts to almost nil and essentially all fluid in therein has been discharged. The hole 2A is no longer fluidly connected to the hole 3A. The enclosed space 204 disappears, i.e., connected to space between another lobe of the inner surface 100 and the outer surface 200. At location shown in FIG. 3E, the enclosed space 203 disappears, i.e., connected to space between another lobe of the inner surface 100 and the outer surface 200. In this particular example, 6 enclosed spaces form, contracts and disappear and 6 enclosed spaces form, expands and disappear while the piston 2 translates by a full circle along the circular path 150.

Figure 4:
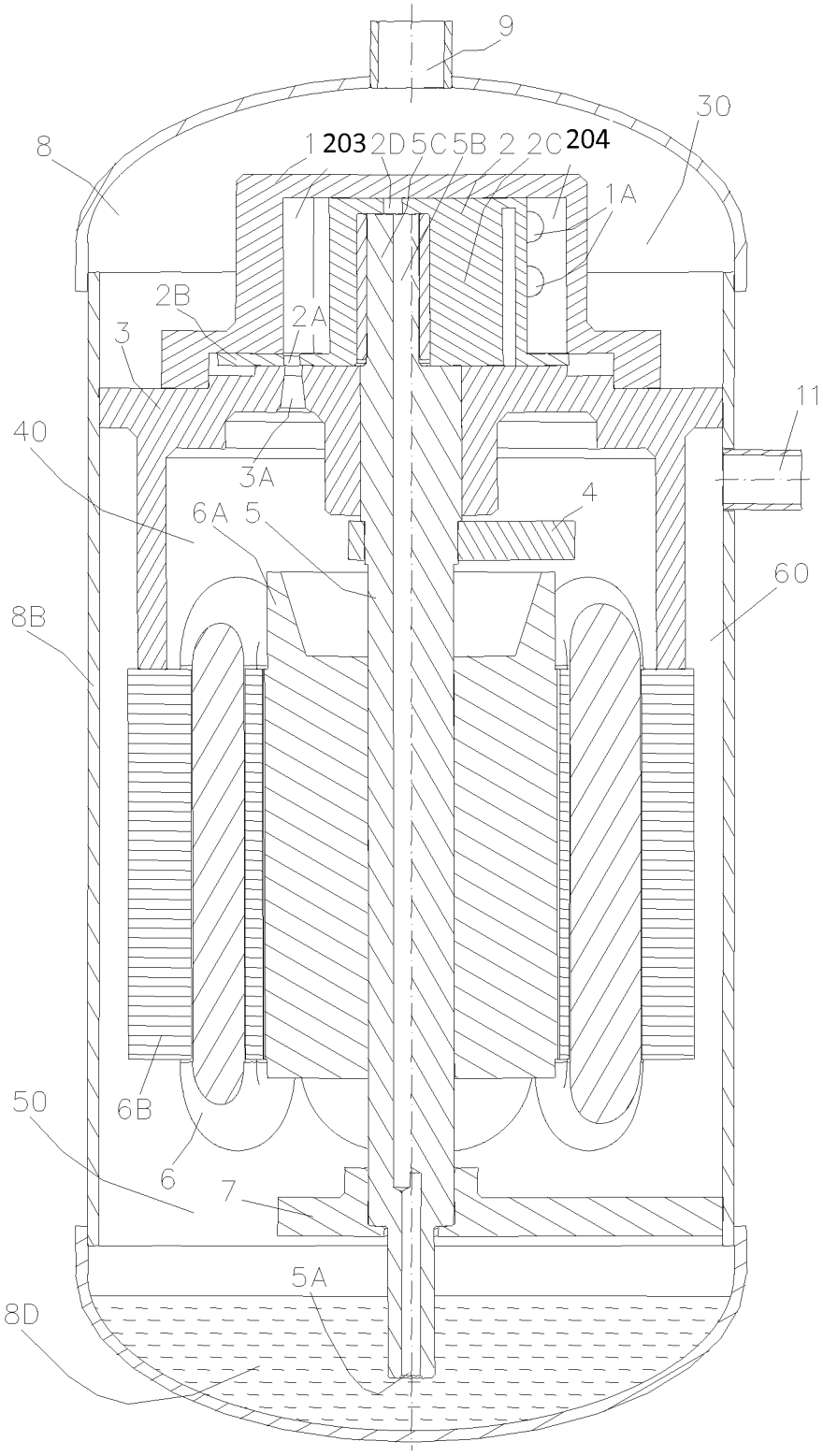
FIG. 4 shows a sectional view of a device according to an embodiment.

FIG. 4 is a cross-sectional view of a device according to an embodiment. In this embodiment, the channels 1A are located through a side wall of the chamber wall 1, connecting the outer surface and inner surface of the chamber wall 1. The piston 2 has the seal plate 2B fixed to a main body 2C of the piston 2. The main body 2C of the piston 2 can be viewed as a boss extending from the seal plate 2B into the lobed chamber. The term "main body 2C" and "boss 2C" are used interchangeable here after. The height of the boss 2C and the depth of the lobed chamber are substantially equal so as to form seals between the piston 2 and the chamber wall 1. The piston 2 also has a blind bearing hole open from the seal plate 2B, and an oil channel 2D connecting the blind bearing hole to an end surface of the boss 2C.

The holes 3A of the transportation plate 3 is fluidly connected to a lower chamber 40. The holes 3A can have a cross-sectional shape of a nozzle, i.e., the opening of the holes 3A open to the lower chamber 40 is larger in area than the opening of the holes 3A facing the seal plate 2B. Such cross-sectional shape of the holes 3A can be effective to lower the fluid flow speed through the holes 3A and decrease fluid flow resistance.

A driving shaft 5 is operably connected with a rotor 6A of an electric motor 6. An oil channel through the driving shaft 5 opens at opening 5A at one end of the driving shaft 5 and at opening 5B at another end of the driving shaft 5.

An upper portion 5C of the driving shaft 5 is disposed in the blind bearing hole of the piston 2 and rotatably connected to the piston 2 through a bearing. An axis of the upper portion 5C is displaced from an axis of the driving shaft 5. The upper portion 5C converts the rotational movement of the driving shaft 5 to the translation of the piston 2 along a circular path 150.

A counterweight 4 is connected to the driving shaft 5 to counter centrifugal force caused by translation of the piston 2 that is eccentric relative to the driving shaft 5 and to reduce vibration.

A shell 8 fixed to transportation plate 3 and chamber wall 1, is part of an enclosure that encloses the chamber wall 1, piston 2, transportation plate 3, and has at least one fluid inlet 9 and at least one outlet 11.

Low temperature fluid flows through the inlet 9 into an upper chamber 30, and the channel 1A of chamber wall 1, into the lobed chamber. The low temperature fluid can be effective to cool the chamber wall 1 and the piston 2 and reduce the temperature of the fluid in the lobed chamber and increase compression efficiency. Fluid discharged from the lobed chamber flows through holes 2A of piston 2 and holes 3A of transportation plate 3 into a lower chamber 40, then flows through the electric motor 6, which can cool the motor 6, and into a bottom chamber 50. The fluid finally flows through a gap between the motor 6 and a shell 8B and is exhausted through the outlet 11.

The fluid in bottom chamber 50 produces high force on the surface of the oil in an oil pool 8D and causes the oil to flow into the driving shaft oil channel opening 5A which is submerged in the oil. The oil reaches another end 5B of the driving shaft 5. Some of the oil flows through a gap in a bearing in the bearing shaft of the piston 2 and into a gap between the transportation plate 3 and the seal plate 2B so as to reduce friction therebetween. Some of the oil flows through the oil channel 2D of piston 2 and into a gap between the boss 2C and the chamber wall 1 and the lobed chamber so as to reduce friction between the piston 2 and the chamber wall 1, and cool the chamber wall 1 and piston 2. The oil flows through the holes 3A and returns to the oil pool 8D.

When the oil flows through the oil channel 2D into the lobed chamber, and the fluid in the lobed chamber is compressed, the piston 2 can be urged to move axially away from the chamber wall 1, which can break the seal between the chamber wall 1 and the piston 2 and cause leakage. High pressure fluid in the lower chamber 40 exerts force through holes 3A onto the seal plate 2B and pushes the piston 2 against the chamber wall 1, which enhances seal of between the chamber 1 and the piston 2.

Figure 5:
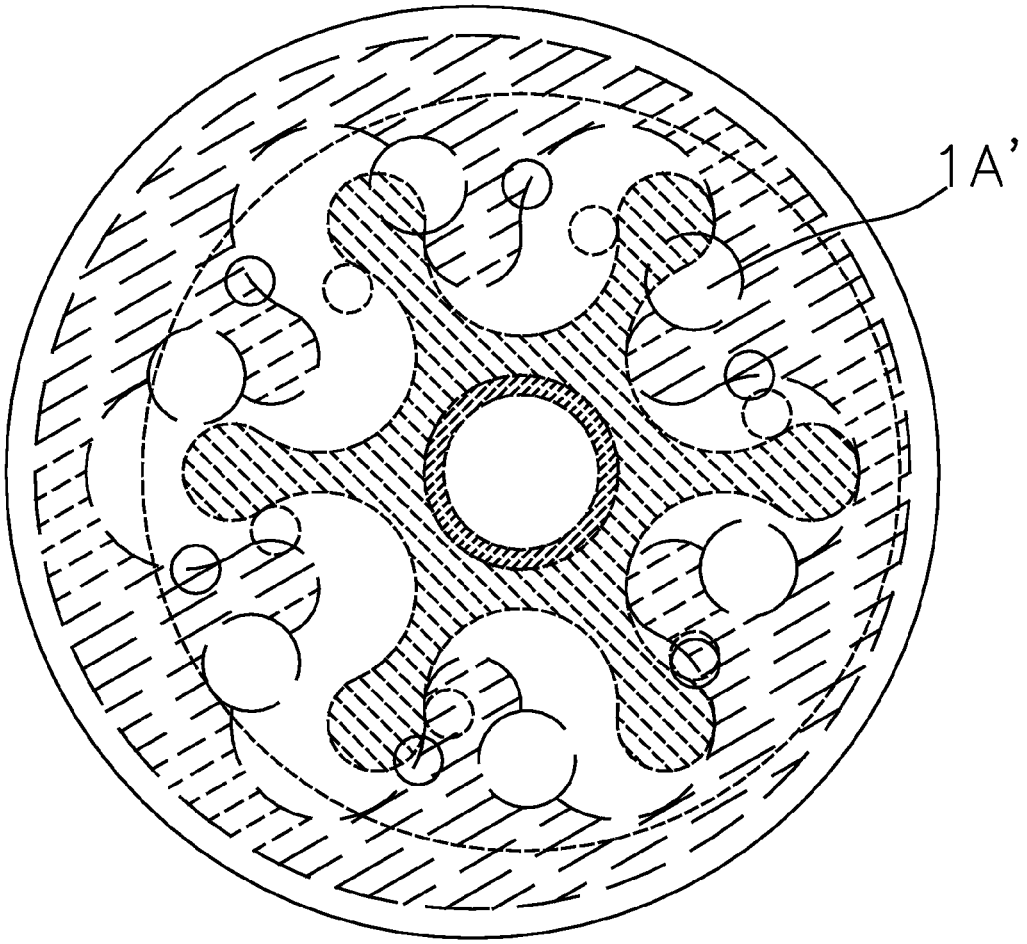
FIG. 5 shows and end view of the chamber wall and the piston wherein channels are located through an end surface of the chamber wall.
Figure 6:
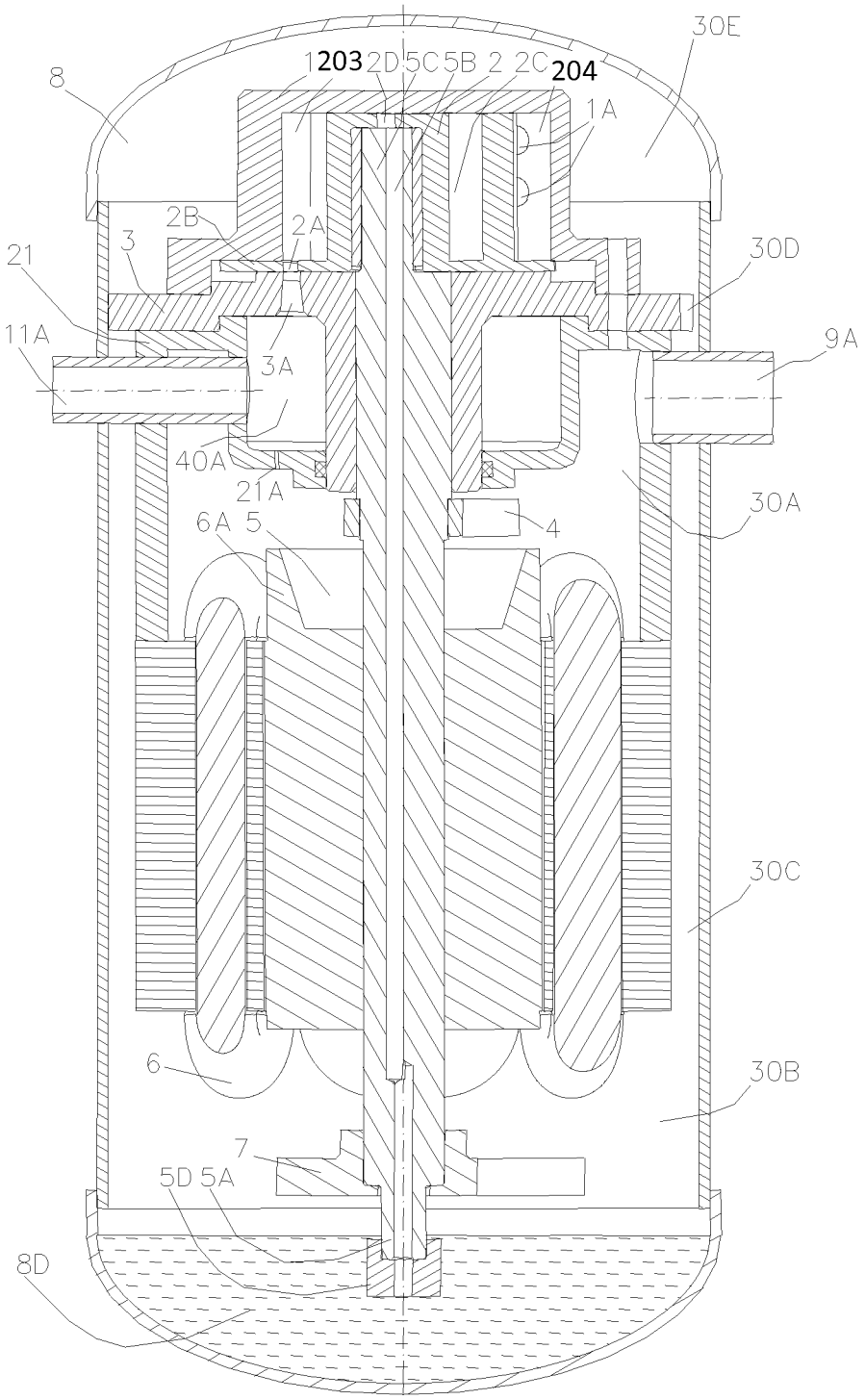
FIG. 6 shows a sectional view of a device according to an embodiment.

FIG. 6 is a vertical sectional view of a device according to an embodiment. In this embodiment, the channels 1A are located through a side wall of the chamber wall 1, connecting the outer surface and inner surface of the chamber wall 1. The channels 1A' can also be located through an end surface of the chamber wall 1 shown in FIG. 5.

The piston 2 has the seal plate 2B fixed to a main body 2C of the piston 2. The main body 2C of the piston 2 can be viewed as a boss extending from the seal plate 2B into the lobed chamber. The term "main body 2C" and "boss 2C" are used interchangeable here after. The height of the boss 2C and the depth of the lobed chamber are substantially equal so as to form seals between the piston 2 and the chamber wall 1. The piston 2 also has a blind bearing hole open from the seal plate 2B, and an oil channel 2D connecting the blind bearing hole to an end surface of the boss 2C.

The holes 3A of the transportation plate 3 is fluidly connected to a lower chamber 40A. The holes 3A can have a cross-sectional shape of a nozzle, i.e., the opening of the holes 3A open to the lower chamber 40 is larger in area than the opening of the holes 3A facing the seal plate 2B. Such cross-sectional shape of the holes 3A can be effective to lower the fluid flow speed through the holes 3A and decrease fluid flow resistance.

A high pressure shell 21 is fixed with the transportation plate 3, is used to collect high pressure fluid discharged from holes 3A in transportation plate 3.

A driving shaft 5 is operably connected with a rotor 6A of an electric motor 6. An oil channel through the driving shaft 5 opens at opening 5A at one end of the driving shaft 5 and at opening 5B at another end of the driving shaft 5.

An upper portion 5C of the driving shaft 5 is disposed in the blind bearing hole of the piston 2 and rotatably connected to the piston 2 through a bearing. An axis of the upper portion 5C is displaced from an axis of the driving shaft 5. The upper portion 5C converts the rotational movement of the driving shaft 5 to the translation of the piston 2 along a circular path 150.

A counterweight 4 is connected to the driving shaft 5 to counter centrifugal force caused by translation of the piston 2 that is eccentric relative to the driving shaft 5 and to reduce vibration.

A shell 8 which is fixed to transportation plate 3 and chamber wall 1, is part of an shell that encloses the chamber wall 1, piston 2, transportation plate 3, and has at least one fluid inlet 9A and at least one outlet 11A.

Low temperature fluid flows through the inlet 9A into a chamber 30A inside the shell 21, through the motor 6 so as to cool the motor 6, into a chamber 30B, through a space 30C between the motor 6 and the shell 21 so as to cool the motor 6, through a gap 30D between the transportation plate 3 and the shell 21 into a chamber 30E. Fluid in the chamber 30E then flows through the channel 1A of chamber wall 1, into the lobed chamber. The low temperature fluid can be effective to cool the chamber wall 1 and the piston 2 and reduce the temperature of the fluid in the lobed chamber and increase compression efficiency. Fluid discharged from the lobed chamber flows through holes 2A of piston 2 and holes 3A of transportation plate 3 into a chamber 40A, and finally is exhausted through the outlet 11A.

The fluid in the chamber 30B produces high force on the surface of the oil in an oil pool 8D and causes the oil to flow into the driving shaft oil channel opening 5A which is submerged in the oil. The oil reaches another end 5B of the driving shaft 5. Some of the oil flows through a gap in a bearing in the bearing shaft of the piston 2 and into a gap between the transportation plate 3 and the seal plate 2B so as to reduce friction therebetween. Some of the oil flows through the oil channel 2D of piston 2 and into a gap between the boss 2C and the chamber wall 1 and the lobed chamber so as to reduce friction between the piston 2 and the chamber wall 1, and cool the chamber wall 1 and piston 2. The oil flows through the holes 3A, 21A and returns to the oil pool 8D.

When the oil flows through the oil channel 2D into the lobed chamber, and the fluid in the lobed chamber is compressed, the piston 2 can be urged to move axially away from the chamber wall 1, which can break the seal between the chamber wall 1 and the piston 2 and cause leakage. High pressure fluid in the lower chamber 40A exerts force through holes 3A onto the seal plate 2B and pushes the piston 2 against the chamber wall 1, which enhances seal of between the chamber 1 and the piston 2.

Figure 7:
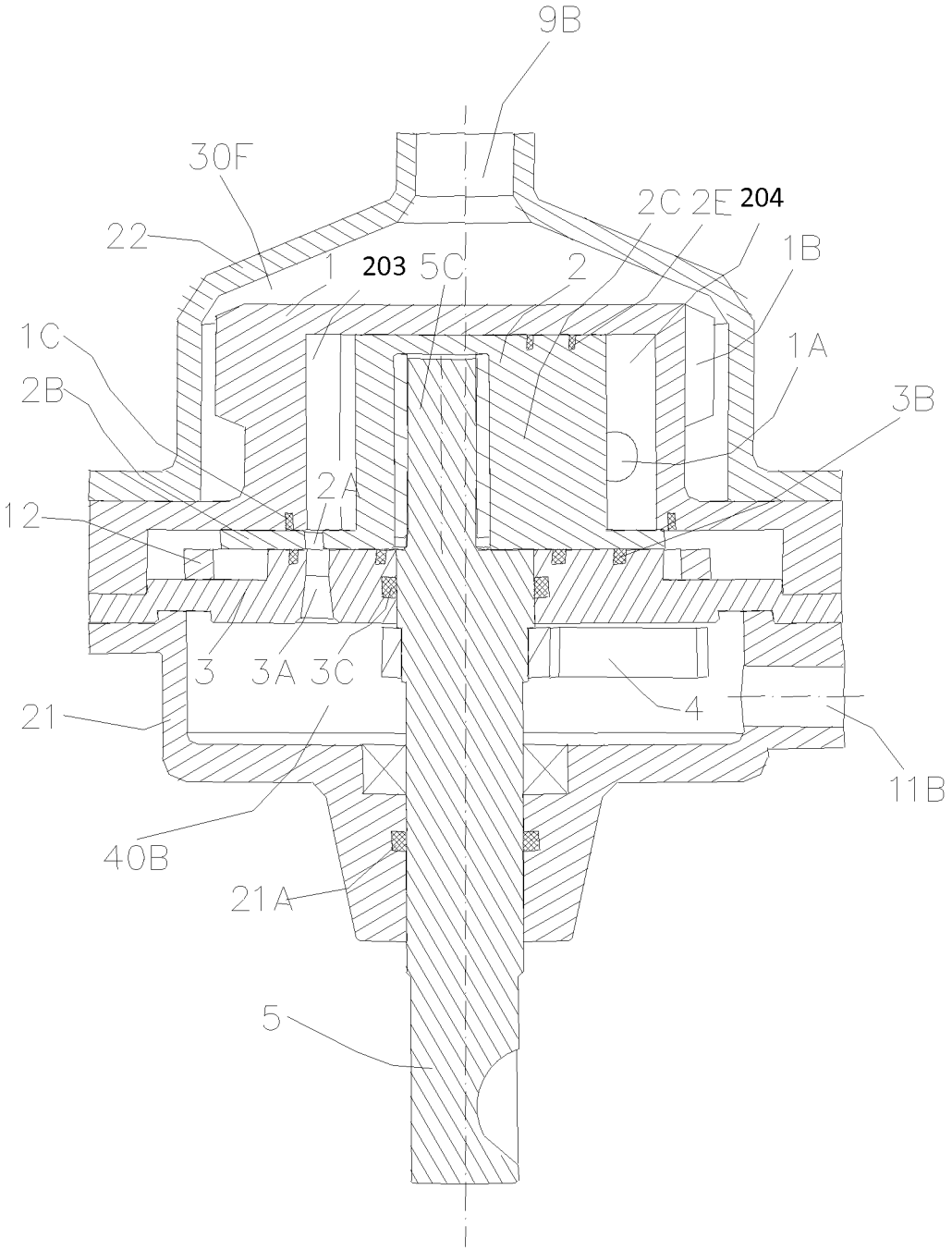
FIG. 7 shows a sectional view of a device according to an embodiment.

FIG. 7 is a vertical sectional view of a device according to an embodiment. The device in this embodiment can be used to transport clean fluid. In this embodiment, the channels 1A are located through a side wall of the chamber wall 1, connecting the outer surface and inner surface of the chamber wall 1. The channels 1A' can also be located through an end surface of the chamber wall 1 shown in FIG. 5. The chamber wall 1 has at least one groove 1C located in and open to a surface of the chamber wall 1, wherein the surface faces the seal plate 2B. The groove 1C is filled in lubricant effective to form a fluid-tight seal and provide lubrication between the seal plate 2B and the chamber wall 1.

The piston 2 has the seal plate 2B fixed to a main body 2C of the piston 2. The main body 2C of the piston 2 can be viewed as a boss extending from the seal plate 2B into the lobed chamber. The term "main body 2C" and "boss 2C" are used interchangeable here after. The height of the boss 2C and the depth of the lobed chamber are substantially equal so as to form seals between the piston 2 and the chamber wall 1. The piston 2 also has a blind bearing hole open from the seal plate 2B. The boss 2C has at least one groove 2E located in and open to an end surface of the boss 2C, wherein the end surface faces the chamber wall 1. The groove 2E is filled in lubricant effective to form a fluid-tight seal and provide lubrication between the boss 2C and the chamber wall 1.

The holes 3A of the transportation plate 3 is fluidly connected to a lower chamber 40B. The holes 3A can have a cross-sectional shape of a nozzle, i.e., the opening of the holes 3A open to the lower chamber 40B is larger in area than the opening of the holes 3A facing the seal plate 2B. Such cross-sectional shape of the holes 3A can be effective to lower the fluid flow speed through the holes 3A and decrease fluid flow resistance. The transportation plate 3 has at least one groove 3B located in and open to a surface of the transportation plate, wherein the surface faces the seal plate 2B. The groove 3B is filled in lubricant effective to form a fluid-tight seal and provide lubrication between the seal plate 2B and the transportation plate 3.

A high pressure shell 21 is fixed with the transportation plate 3, is used to collect high pressure fluid comes from holes 3A in transportation plate 3. The said high pressure shell 21 has groove 21A in which filled with material of lubrication and seal.

A high pressure shell 21 is fixed with the transportation plate 3, is used to collect high pressure fluid discharged from holes 3A in transportation plate 3. The shell 21 has at least one outlet 11B.

A low pressure shell 22 is fixed with the chamber wall 1. The shell 22 has at least one inlet 9B.

A driving shaft 5 can be connected to a motor (not shown in FIG. 7).

An upper portion 5C of the driving shaft 5 is disposed in the blind bearing hole of the piston 2 and rotatably connected to the piston 2 through a bearing. An axis of the upper portion 5C is displaced from an axis of the driving shaft 5. The upper portion 5C converts the rotational movement of the driving shaft 5 to the translation of the piston 2 along a circular path 150.

An anti-rotation ring 12 can be disposed in the device and operable to prevent rotation of the piston 2 during the translation of the piston 2 along the circular path 150.

A counterweight 4 is connected to the driving shaft 5 to counter centrifugal force caused by translation of the piston 2 that is eccentric relative to the driving shaft 5 and to reduce vibration.

Low temperature fluid flows through the inlet 9B into a chamber 30F inside the shell 22, through heat sink fins 1B on the chamber wall 1 so as to cool the chamber wall 1. Fluid in the chamber 30F then flows through the channel 1A of chamber wall 1, into the lobed chamber. The low temperature fluid can be effective to cool the chamber wall 1 and the piston 2 and reduce the temperature of the fluid in the lobed chamber and increase compression efficiency. Fluid discharged from the lobed chamber flows through holes 2A of piston 2 and holes 3A of transportation plate 3 into a chamber 40B, and finally is exhausted through the outlet 11B.

When the fluid in the lobed chamber is compressed, the piston 2 can be urged to move axially away from the chamber wall 1, which can break the seal between the chamber wall 1 and the piston 2 and cause leakage. High pressure fluid in the lower chamber 40B exerts force through holes 3A onto the seal plate 2B and pushes the piston 2 against the chamber wall 1, which enhances seal of between the chamber 1 and the piston 2.

Figure 8:
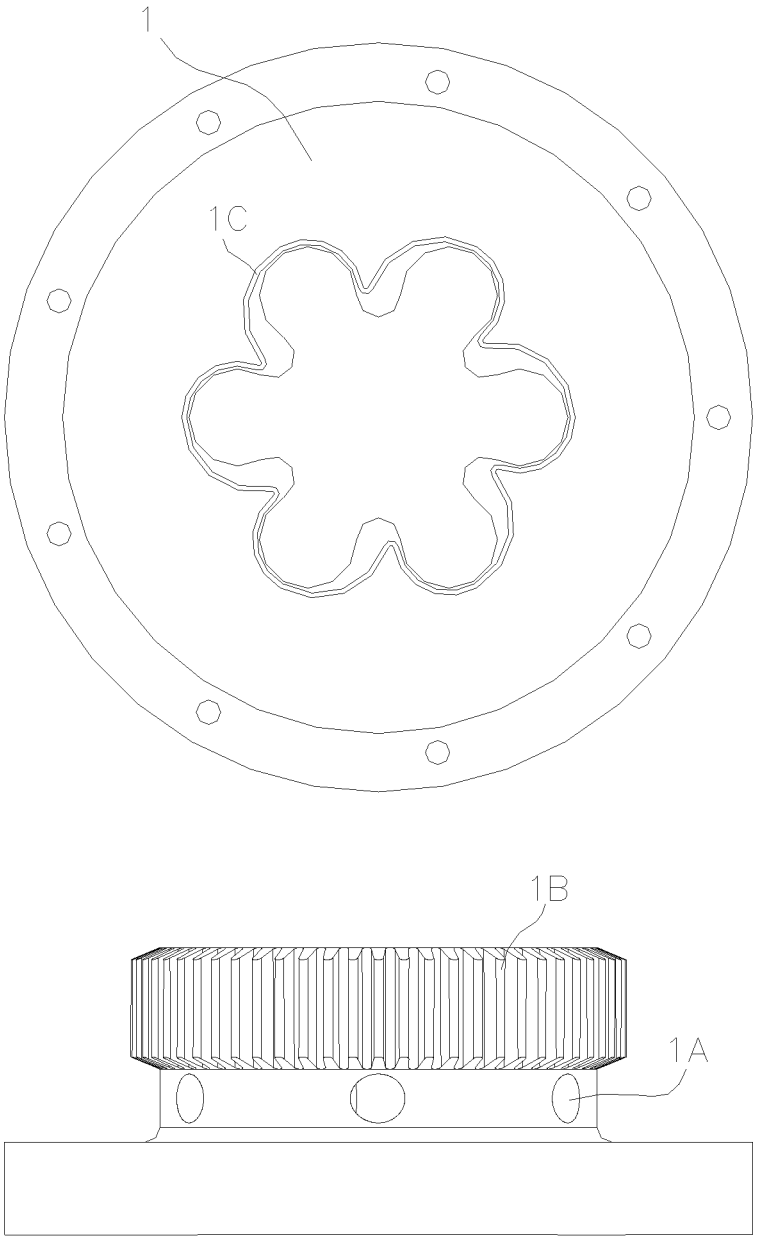
FIG. 8 shows a top view of an exemplary chamber wall.
Figure 9:
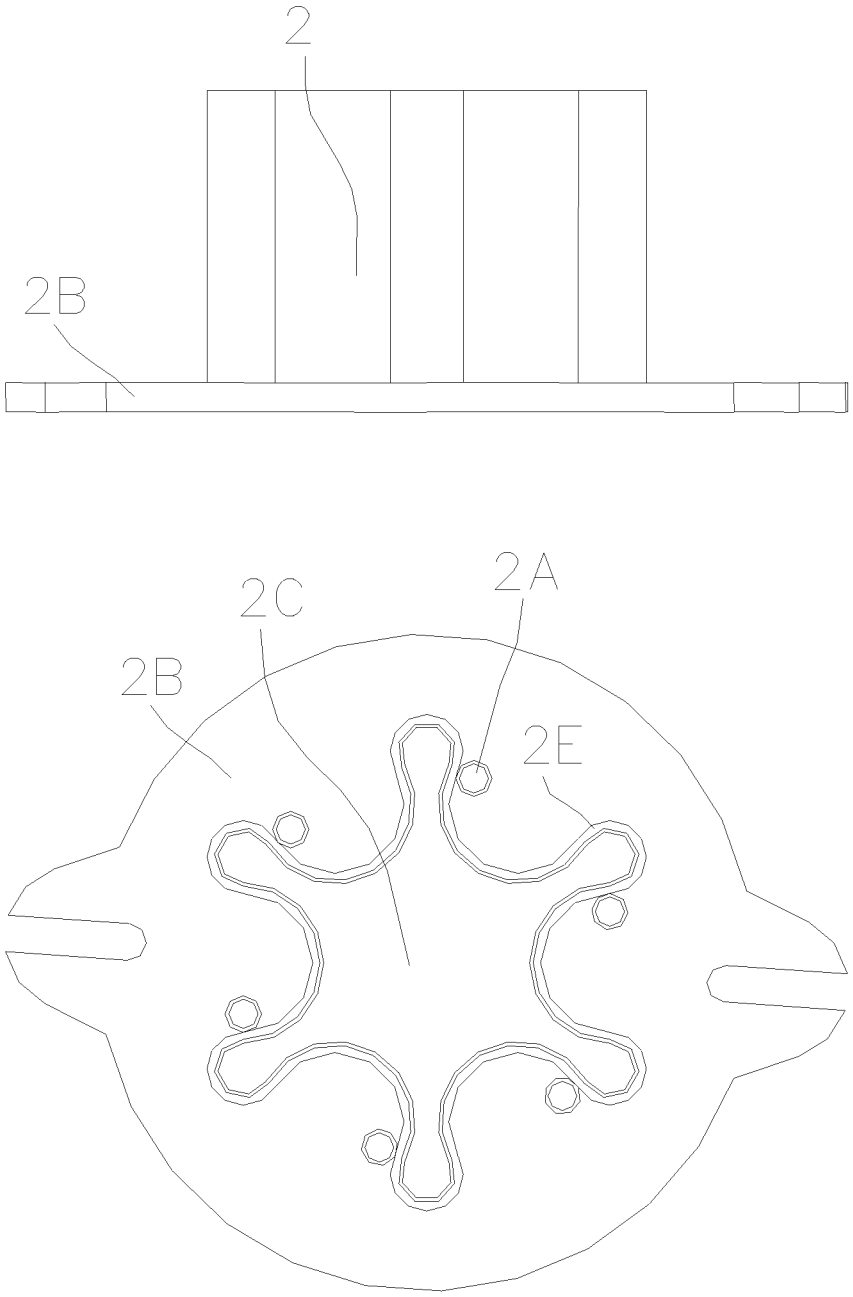
FIG. 9 shows a top view of an exemplary piston.
Figure 10:
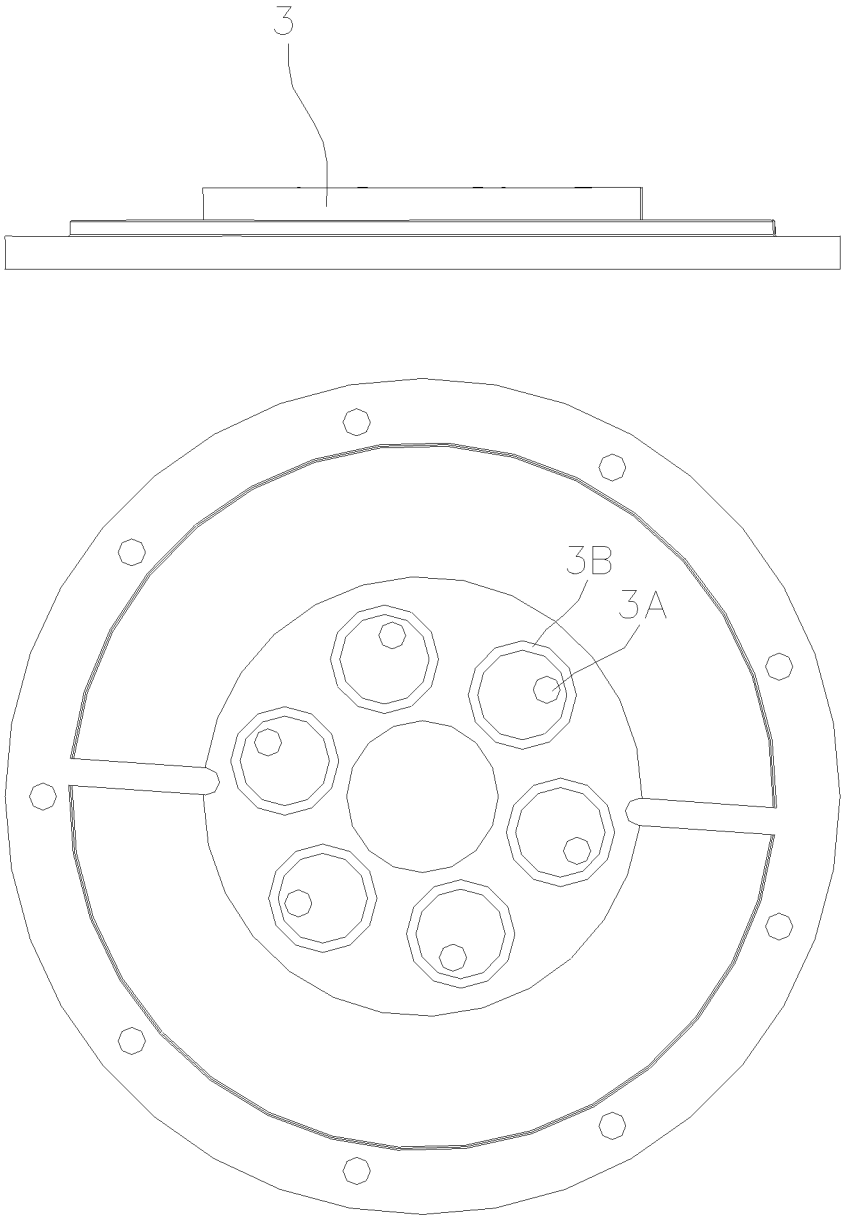
FIG. 10 shows a top view of an exemplary transportation plate.

Each pair of surface the move relative to each other is lubricated by solid lubricant to reduce friction loss and enhance seal therebetween. For example, grooves 1C and 2E provide lubricant and form a fluid-tight seal between the chamber wall 1 and the piston 2. FIG. 8 shows a top view of an exemplary chamber wall 1 with the groove 1C. FIG. 9 shows a top view of an exemplary piston 2 with the groove 2E. Groove 3B provides lubricant and form a fluid-tight seal between the seal plate 2B and the transportation plate 3. FIG. 10 shows a top view of an exemplary transportation plate 3 with the groove 3B. The transportation plate 3 can further have a groove 3C in and open to a surface facing the driving shaft 5 to provide lubricant and form a fluid-tight seal between the transportation plate 3 and the driving shaft 5. The shell 21 can have a groove 21A in and open to a surface facing the driving shaft 5 to provide lubricant and form a fluid-tight seal between the shell 21 and the driving shaft 5. The grooves 1C, 2E, 3B, 3C can be arranged in any suitable fashion. The device can have any suitable number of grooves to provide lubricant.

Figure 11:
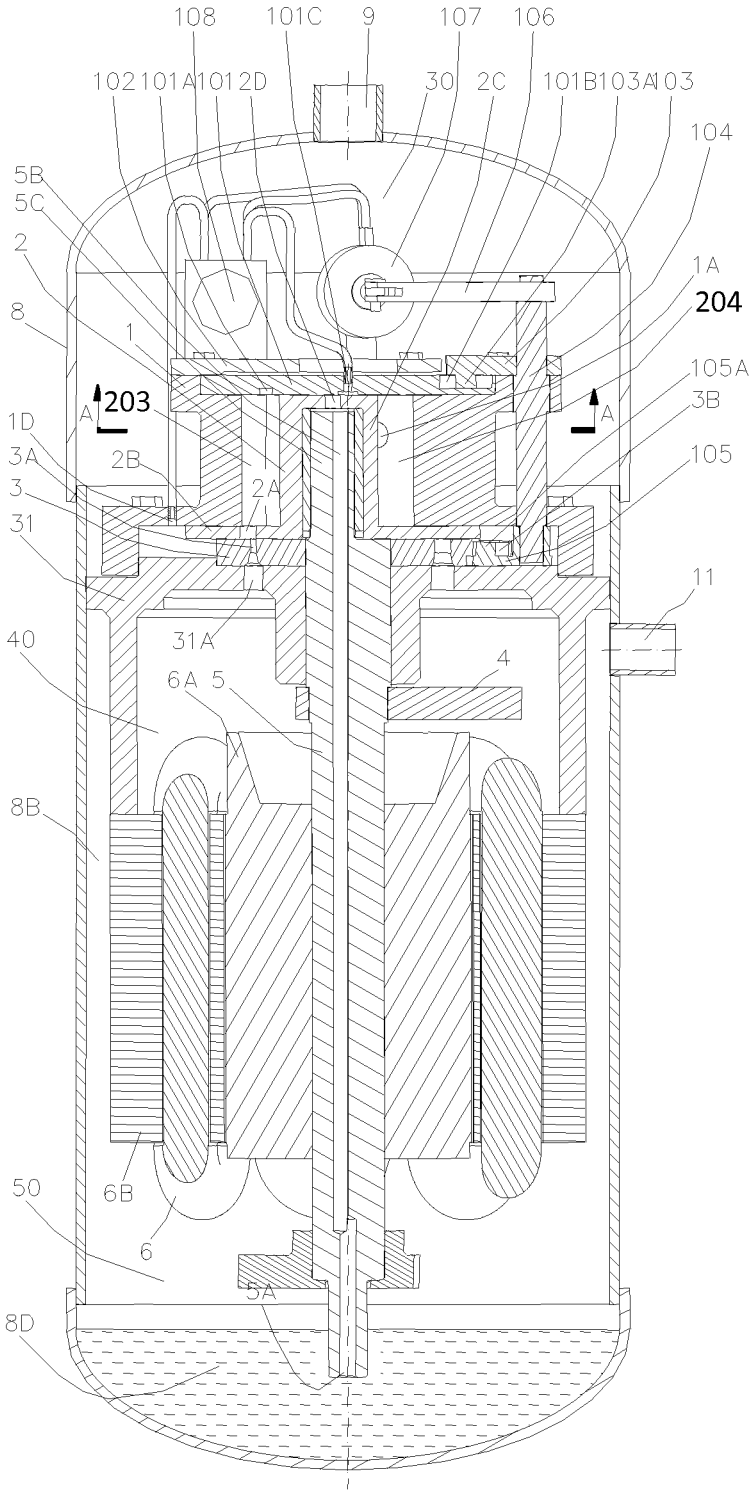
FIG. 11 is a vertical sectional view of a device according to an embodiment.
Figure 12:
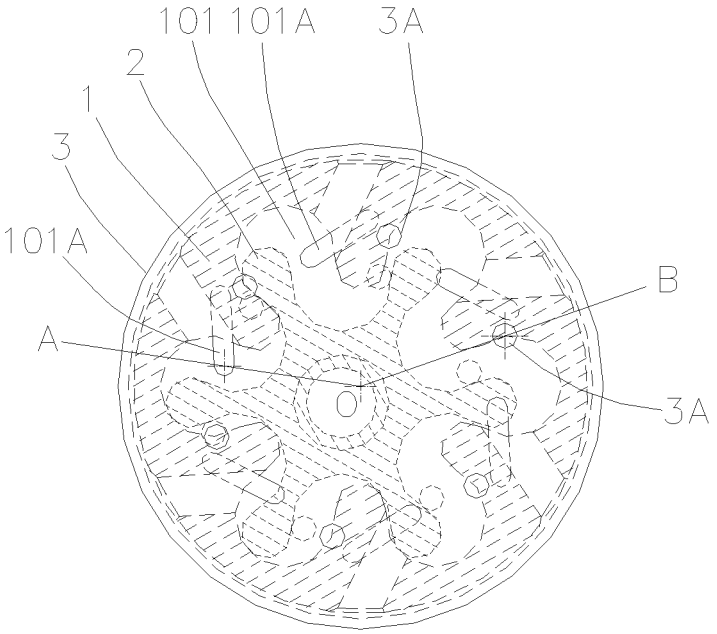
FIG. 12 is a sectional view of the surface A-A in FIG. 11.
Figure 12:
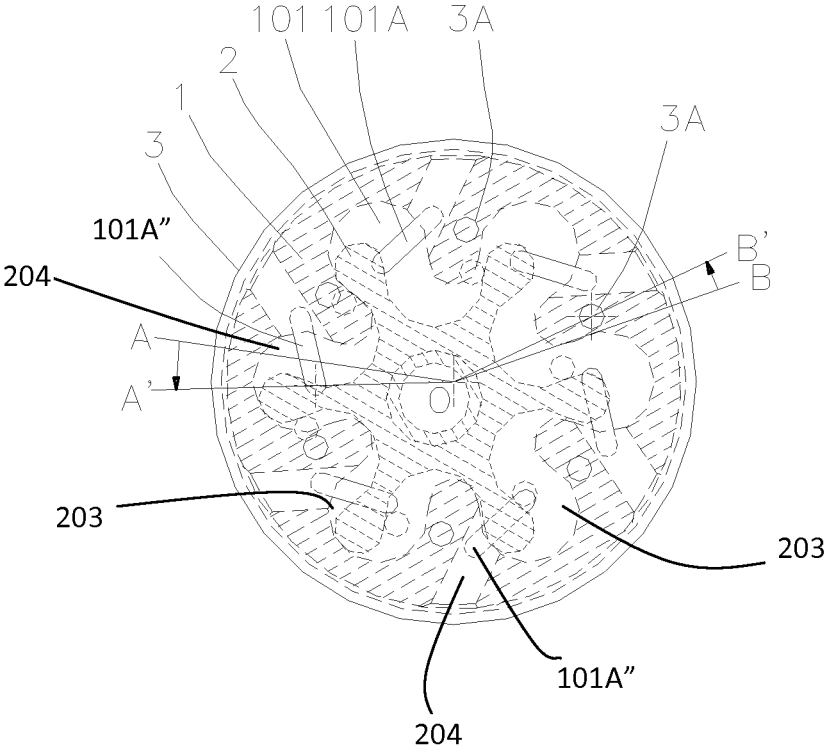
Figure 13:
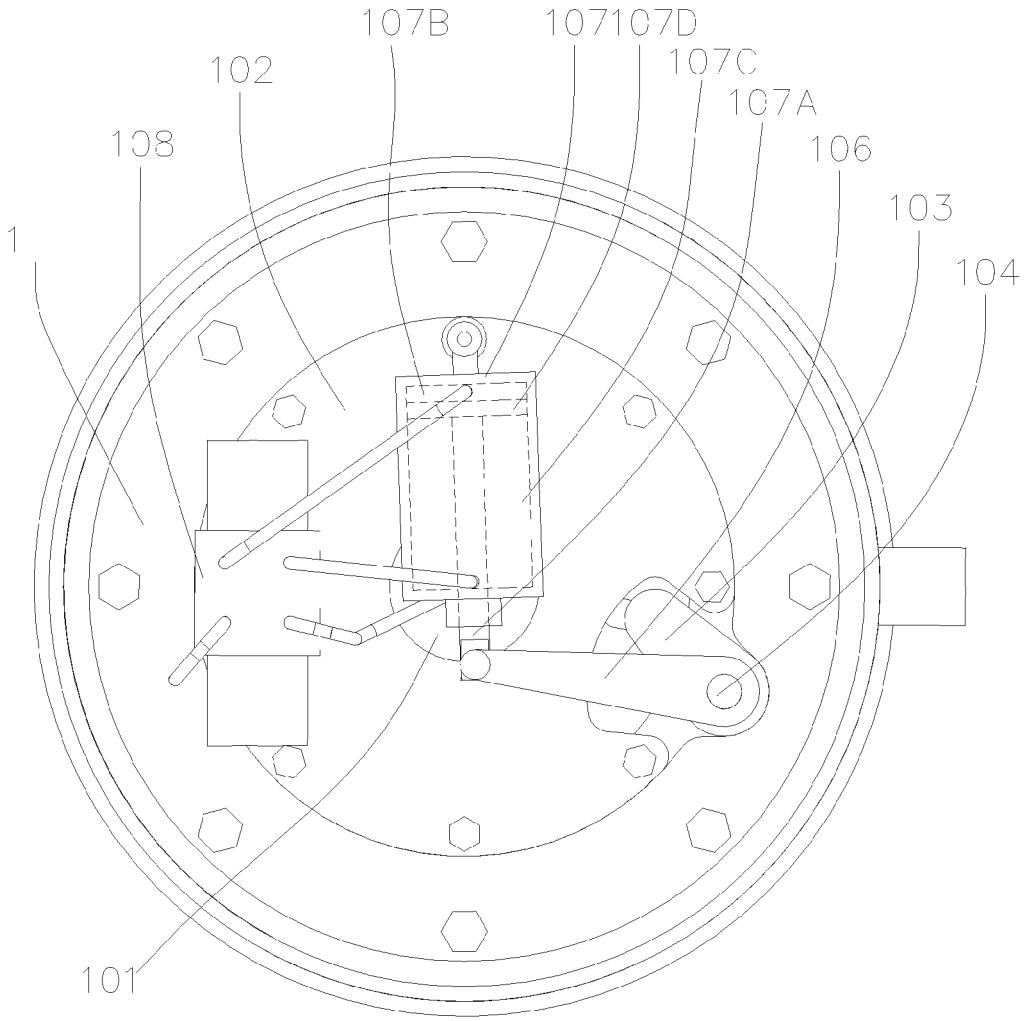
FIG. 13 is a view of the device in FIG. 11 from the top of the device with a shell removed.

FIG. 11 is a vertical sectional view of a device according to an embodiment. FIG. 12 is a sectional view of the surface A-A in FIG. 11, with the piston 2, the chamber wall 1 and the transportation plate 3 overlaid thereon. FIG. 13 is a view of the device in FIG. 11 from the top of the device with a shell removed. Same reference numerals in FIGS. 11-13 refer to the same feature.

In this embodiment, a flow regulation plate 101 is rotatably attached to and forms a fluid-tight seal with the chamber wall 1, and forms the bottom of the lobed chamber. The flow regulation plate 101 can be attached to the chamber wall 1 by any suitable means, such as being retained in a recess on the chamber wall 1 by a cover plate 102. The cover plate 102 is effective to maintain a fluid-tight seal between the flow regulation plate 101 and the chamber wall 1.

The flow regulation plate 101 has connection slots 101A in and open to a surface of the flow regulation plate 101, the surface facing the lobed chamber. The connection slots 101A correspond to the lobes of the lobed chamber. FIG. 12 is a top view of an exemplary flow regulation plate 101 with the chamber wall 1 and the piston 2 overlaid thereon. At some rotational positions of the flow regulation plate 101 relative to the chamber wall 1, the connection slots 101A connect the enclosed space 203 as a compression chamber and the enclosed space 204 as an intake chamber (e.g., 101A" in FIG. 12, which is one of the slots 101A), effectively reducing the volume of the enclosed space 203. When the enclosed space 203 and the enclosed space 204 are connected by the connection slots 101A, fluid can flow between the enclosed spaces 203 and 204 through the connection slots 101A. By changing the rotational position of the flow regulation plate 102 relative to the chamber 1, the duty cycle of the connection between the enclosed spaces 203 and 204, and the amount of fluid in the enclosed space 203, can adjusted. The rotational movement of the flow regulation plate 101 can be driven by any suitable mechanism. For example, the flow regulation plate 101 can have a lever slot 101B engaged with a drive pole 103A of a flow regulation lever 103. The flow regulation plate 101 can have an oil channel 101C for delivery of lubricant between the flow regulation plate 101 and the piston 2. The oil channel 101C can be fluidly connected to a four-way solenoid valve 108.

The piston 2 has the seal plate 2B fixed to a main body 2C of the piston 2. The main body 2C of the piston 2 can be viewed as a boss extending from the seal plate 2B into the lobed chamber. The term "main body 2C" and "boss 2C" are used interchangeable here after. The height of the boss 2C and the depth of the lobed chamber are substantially equal so as to form seals between the piston 2 and the chamber wall 1 and between the piston 2 and the flow regulation plate 101. The piston 2 also has a blind bearing hole open from the seal plate 2B, and an oil channel 2D connecting the blind bearing hole to an end surface of the boss 2C.

The transportation plate 3 is rotatably attached to the chamber wall 1 by any suitable mechanism. For example the transportation plate 3 can be retained in a recess in a support 31 and urged against the chamber wall 1 by the support 31. The holes 3A can have a cross-sectional shape of a nozzle, i.e., the opening of the holes 3A open to the lower chamber 40 is larger in area than the opening of the holes 3A facing the seal plate 2B. Such cross-sectional shape of the holes 3A can be effective to lower the fluid flow speed through the holes 3A and decrease fluid flow resistance. The rotation of the transportation plate 3 can be drive by any suitable mechanism. For example, the transportation plate 3 can have a lever slot 3B engaged with a drive pole 105A of a pre-compression ratio regulation lever 105, for driving the transportation plate. Rotation of the transportation plate 3 and rotation of the flow regulation plate 101 are linked, which maintains the pre-compression ratio despite change of the volume of the enclosed space 203 effected by the flow regulation plate 101. The term "pre-compression ratio" as used herein means the pressure ratio of compressed fluid in the compression chamber to uncompressed fluid at the moment when the holes 2A begins to overlap with the holes 3A. The rotation of the flow regulation plate 101 and the transportation plate 103 can be linked by any suitable mechanism. In one example, as shown in FIG. 11 and FIG. 13, a drive lever 106 is connected with a slider 107A of a hydraulic actuator 107 and lever axle 104, to transfer the from slide 107A to lever axle 104. The hydraulic actuator 107 controls the slider 107A and drives the lever axle 104 to rotate. The lever axle 104 is connected to the flow regulation lever 103 and the pre-compression ratio regulation lever 105.

As shown in FIG. 12, the piston 2 translates along a circular path 150 counterclockwise around the symmetry center axis of the chamber wall 1. The upper panel of FIG. 12 demonstrates a state without flow regulation, wherein the connection slots 101A of the flow regulation plate 101 are not fluidly connected to any enclosed space 203 and thus have no influence to compression in the enclosed space 203. OA is an initial angular position of one of the connection slots 101A; OB is an initial angular position of one of the holes 3A. The lower panel of FIG. 12 demonstrates a state with flow regulation. Compared to the state shown in the upper panel of FIG. 12, the flow regulation plate 101 rotates around the symmetry center axis of the chamber wall 1 by an angle AOA'; and the transportation plate 3 rotates around the symmetry center axis of the chamber wall 1 by an angle is BOB'. Angle AOA' is preferably greater than angle BOB'. In the state of the lower panel of FIG. 12, when the enclosed space 203 as the compression chamber forms and the enclosed space 204 as the intake chamber are connected through the connection slot 101A" and thus the fluid inside the enclosed space 203 is not compressed and flows into the enclosed space 204 as the piston 2 translates. When the piston 2 translates to a position wherein the connection slot 101A" is no longer connected to both the enclosed spaces 203 and 204, the fluid inside the enclosed space 204 begins to be compressed. Rotation of the transportation plate 3 and the flow regulation plate 101 are synchronized such that a nearly constant pre-compression ratio is maintained, which leads to high compression efficiency.

The support 31 is fixed with the shell 8, and has holes 31A corresponding to and fluidly connected to the holes 3A. Fluid discharged from the holes 3A flows through the holes 31A into the chamber 40. High pressure fluid in the lower chamber 40 exerts force through holes 31A and 3A onto the transportation plate 3 and the seal plate 2B, pushes the transportation plate 3 against the piston 2, and pushes the piston 2 against the chamber wall 1, which enhances seal of between the transportation plate 3 and the piston 2, and seal of between the chamber 1 and the piston 2.

The four-way solenoid valve 108 is used to control the action of the hydraulic actuator 107. When the four-way solenoid valve 108 is not powered, hydraulic fluid is blocked inside the hydraulic actuator 107 and the slider 107A of the hydraulic actuator 107 is locked. When an increment solenoid of the four-way solenoid valve 108 is powered, the oil channel 101C, which delivers high pressure lubricant (e.g., hydraulic oil) is fluidly connected with an oil chamber 107B of the hydraulic actuator 107; an oil chamber 107C is fluidly connected with an oil channel 1D, which delivers low pressure oil. The pressure differential in the oil chambers 107B and 107A causes the slider 107A to move away from the oil chamber 107B, which turns the flow regulation plate 101 and the transportation plate 3 counterclockwise in FIG. 13. When a decrement solenoid of the four-way solenoid valve 108 is powered, the oil channel 101C, which delivers high pressure lubricant (e.g., hydraulic oil) is fluidly connected with the oil chamber 107C of the hydraulic actuator 107; the oil chamber 107B is fluidly connected with an oil channel 1D, which delivers low pressure oil. The pressure differential in the oil chambers 107B and 107A causes the slider 107A to move towards the oil chamber 107B, which turns the flow regulation plate 101 and the transportation plate 3 clockwise in FIG. 13.

A driving shaft 5 is operably connected with a rotor 6A of an electric motor 6. An oil channel through the driving shaft 5 opens at opening 5A at one end of the driving shaft 5 and at opening 5B at another end of the driving shaft 5.

An upper portion 5C of the driving shaft 5 is disposed in the blind bearing hole of the piston 2 and rotatably connected to the piston 2 through a bearing. An axis of the upper portion 5C is displaced from an axis of the driving shaft 5. The upper portion 5C converts the rotational movement of the driving shaft 5 to the translation of the piston 2 along a circular path 150.

A counterweight 4 is connected to the driving shaft 5 to counter centrifugal force caused by translation of the piston 2 that is eccentric relative to the driving shaft 5 and to reduce vibration.

The shell 8 which is fixed to transportation plate 3 and chamber wall 1, is part of an shell that encloses the chamber wall 1, piston 2, transportation plate 3, and has at least one fluid inlet 9 and at least one outlet 11.

Low temperature fluid flows through the inlet 9 into a chamber 30 inside the shell 8, through the channel 1A of chamber wall 1, into the lobed chamber. The low temperature fluid can be effective to cool the chamber wall 1 and the piston 2 and reduce the temperature of the fluid in the lobed chamber and increase compression efficiency. Fluid discharged from the lobed chamber flows through holes 2A of piston 2 and holes 3A of transportation plate 3 into a chamber 40, through the motor 6 so as to cool the motor 6, into a chamber 50, through a space 8B between the motor 6 and the shell 8 and finally is exhausted through the outlet 11.

The fluid in the chamber 50 produces high force on the surface of the oil in an oil pool 8D and causes the oil to flow into the driving shaft oil channel opening 5A which is submerged in the oil. The oil reaches another end 5B of the driving shaft 5. Some of the oil flows through a gap in a bearing in the bearing shaft of the piston 2 and into a gap between the transportation plate 3 and the seal plate 2B so as to reduce friction therebetween. Some of the oil flows through the oil channel 2D of piston 2 and into a gap between the boss 2C and the chamber wall 1, a gap between the boss 2C and the flow regulation plate 101, and the lobed chamber, so as to reduce friction between the piston 2 and the chamber wall 1 and the flow regulation plate 101, and cool the chamber wall 1, piston 2 and flow regulation plate 101. The oil flows through the holes 3A and returns to the oil pool 8D. The oil is also fed through the oil channel 101C to drive the hydraulic actuator 107.

When the oil flows through the oil channel 2D into the lobed chamber, and the fluid in the lobed chamber is compressed, the piston 2 can be urged to move axially away from the chamber wall 1, which can break the seal between the chamber wall 1 and the piston 2 and cause leakage. High pressure fluid in the lower chamber 40 exerts force through holes 3A onto the seal plate 2B and pushes the piston 2 against the chamber wall 1, which enhances seal of between the chamber 1 and the piston 2 and between the piston 2 and the flow regulation plate 101.

A method of generating mechanical power using the device described herein comprises maintaining a pressure differential between openings of the holes 3A of the transportation plate 3 and openings of the channels 1A of the chamber wall 1.

A method of compressing and/or driving a fluid using the device described herein, comprises providing the fluid to the channels 1A of the chamber wall 1 and driving the translation of the piston 2.

In relation to the claims, it is intended that when words such as "a," "an," "at least one," or "at least one portion" are used to preface a feature there is no intention to limit the claim to only one such feature unless specifically stated to the contrary in the claim.

The descriptions above are intended to be illustrative, not limiting. Thus, it will be apparent to one skilled in the art that modifications may be made without departing from the scope of the claims set out below.

What is claimed is:

1. A device comprising:

a chamber wall comprising an outer surface and an inner surface, wherein the inner surface encloses a lobed chamber with a plurality of lobes and the inner surface comprises segments of arcuate surfaces, each of the segments of arcuate surfaces being tangent with its immediate neighboring segments, and wherein the chamber wall further comprises channels connecting the outer surface and the inner surface of the chamber wall, channels through an end surface of the chamber wall, or both the channels connecting the outer surface and the inner surface of the chamber wall and the channels through the end surface of the chamber wall; and a piston configured to translate along a circular path relative to the chamber wall and form enclosed spaces between the piston and the chamber wall;

wherein the piston does not rotate relative to the chamber wall during translation;

wherein the piston comprises an outer surface enclosing a main body of the piston, the main body having a plurality of lobes located in the lobes of the lobed chamber, the outer surface of the piston and the inner surface of the chamber wall engaged during translation and forming a fluid-tight seal between some portions of the outer surface of the piston and the inner surface of the chamber wall;

wherein the device further comprises a seal plate attached to an end of the main body; wherein the seal plate forms a fluid-tight seal with the chamber wall; wherein the seal plate comprises through holes between two opposing surfaces, and the through holes are configured to be fluidly connected to the enclosed spaces.

2. The device of claim 1, further comprising an anti-rotation part operable to prevent rotation of the piston during the translation of the piston along the circular path.

3. The device of claim 1, further comprising a transportation plate that forms a fluid-tight seal with the chamber wall, wherein the transportation plate and the chamber wall enclose the piston in the lobed chamber while allowing the piston to translate therein, and wherein the transportation plate further comprises through holes that overlap and fluidly connect to the through holes in the seal plate of the piston at selected translational positions of the piston relative to the chamber wall.

4. The device of claim 3, wherein the through holes in the transportation plate are located such that portions of the inner surface of the chamber wall overlap each of the holes in the transportation plate.

5. The device of claim 3, wherein at least one of the chamber wall, the transportation plate and the piston comprises at least one groove open to a surface thereof, the at least one groove configured is filled with lubricant effective to form a fluid-tight seal and provide lubrication to the chamber wall, the transportation plate and the piston.

6. The device of claim 3, further comprising a flow regulation plate rotatably attached to the chamber wall, forming a fluid-tight seal with the chamber wall and forming a bottom of the lobed chamber; wherein the flow regulation plate comprises connection slots in and open to a surface of the flow regulation plate, the surface of the flow regulation plate facing the lobed chamber.

7. The device claim 6, wherein the transportation plate is rotatably relative to the chamber wall.

8. The device of claim 7, rotation of the transportation plate and rotation of the flow regulation plate are linked such that a pre-compression ratio is maintained.

9. The device of claim 6, further comprising a mechanism configured to drive the flow regulation plate.

10. The device of claim 9, wherein the mechanism is a hydraulic actuator, the piston comprises an oil channel fluidly connected to the lobed chamber, and the flow regulation plate further comprises an oil channel fluidly connected to the hydraulic actuator and the oil channel of the piston for delivery of lubricant into the hydraulic actuator.

11. A method of generating mechanical power using the device of claim 3, comprising maintaining a pressure differential between openings of the through holes of the transportation plate and openings of the channels of the chamber wall.

12. The device of claim 1 wherein the outer surface of the piston comprises segments of arcuate surfaces, each of the segments of arcuate surfaces being tangent with its immediate neighboring segments.

13. The device of claim 1, further comprising a shaft wherein an upper portion is rotatably connected to the piston and an axis of the upper portion is displaced from an axis of the shaft.

14. The device of claim 13, wherein the shaft comprises an oil channel therein.

15. The device of claim 1, wherein the circular path is concentric with a rotational symmetric center of the chamber wall.

16. The device of claim 1, wherein the piston comprises an oil channel fluidly connected to the lobed chamber, the oil channel configured to provide oil into the lobed chamber for lubrication and cooling.

17. A method of compressing or driving a fluid using the device claim 1, comprising providing the fluid to the channels of the chamber wall and driving the translation of the piston.

18. The device of claim 1, wherein the main body of the piston and the lobed chamber have a same number of lobes.

* * * * *